US007637266B1

(12) United States Patent
Gibbons

(10) Patent No.: US 7,637,266 B1
(45) Date of Patent: Dec. 29, 2009

(54) CONVOLUTED HAIR BAND FOR CREATING MANY VARYING HAIRSTYLES

(76) Inventor: Roger C. Gibbons, Box 55/1 Water St., Mattapoisett, MA (US) 02739

( * ) Notice: Subject to any disclaimer, the term of this patent is extended or adjusted under 35 U.S.C. 154(b) by 302 days.

(21) Appl. No.: 11/393,574

(22) Filed: Mar. 29, 2006

Related U.S. Application Data

(60) Provisional application No. 60/704,520, filed on Aug. 2, 2005.

(51) Int. Cl.
*A45D 8/12* (2006.01)

(52) U.S. Cl. ..... 132/275

(58) Field of Classification Search ..... 132/273, 132/275, 278, 105; D28/39, 41; 2/171, 174
See application file for complete search history.

(56) References Cited

U.S. PATENT DOCUMENTS 537,542 A * 4/1895 Moore ..... 132/275
5,156,171 A * 10/1992 Goodman ..... 132/200
5,239,705 A * 8/1993 Leopold ..... 2/209.13
5,472,003 A * 12/1995 Frame et al. ..... 132/275
6,401,726 B1 * 6/2002 Sonstegard ..... 132/275
2004/0040568 A1 * 3/2004 Tsai ..... 132/275

* cited by examiner

*Primary Examiner*—Robyn Doan
*Assistant Examiner*—Rachel R Steitz
(74) *Attorney, Agent, or Firm*—Robert Nathans

(57) ABSTRACT

A convoluted internally stressed rubber member forms several twisted crossover loop portions. The user's fingers force open one or more loop portions to insert varying hair lengths, separate hair-pieces and/or decorative objects such as jewelry or strips of fabric, to be held therein. When the user's fingers separate from the device, the loop portions contract and grip the inserted items, with 'non holding' loops left free to contract onto themselves. The twisted rubber member is completely covered around its circumference with decorative fabric material. Many fabric compositions can be combined with varying rubber lengths, widths and shapes, and both can be incorporated into differing decorative or functional holding devices to create varying and unique holding embodiments. The device can further hold removable or attachable hair extensions, and or decorative items away from where the users hair is being held, or jointly together to create unique holding patterns.

22 Claims, 5 Drawing Sheets

CONVOLUTED HAIR BAND FOR CREATING MANY VARYING HAIRSTYLES

CROSS-REFERENCE TO RELATED APPLICATIONS

This application claims the benefit of provisional application 60/704,520, filed Aug. 2, 2005.

FIELD OF THE INVENTION

The invention relates to the field of hairstyling.

BACKGROUND OF THE INVENTION

Devices for holding hair are well known and include such designs as clips, teeth, elastic bands, and barrettes. Some prior art devices that have been patented are illustrated in U.S. Pat. No. 5,873,376, that involve resilient material and base members, U.S. Pat. No. 5,379,782 sets forth a diverse hair holder including an elastic band and interlaced tubes. U.S. Pat. No. 4,972,859 shows a receiving cavity and hemispherical members for securing hair. A "Velcro" fastener combination ductile wire device can be seen in U.S. Pat. No. 6,024,103. U.S. Pat. No. 4,892,110 illustrates a "Hair Wrap Device," that was issued to Harvie. It utilizes a ductile metallic strip capable of retaining its coiled shape when coiled about a bundle of hair.

A looped fastener device with an elasticized member and adjusting means can be seen in U.S. Pat. No. 6,182,672. U.S. Pat. No. 5,156,171 issued to Goodman introduces apparatus involving a pull cord and an elasticized ring to grip a ponytail. Revson received U.S. Pat. No. 5,301,696. This ponytail holder includes an elastic interior covered by bunched or gathered fabric, but calls for the user to double or triple over the device to ultimately hold strands of hair. Furthermore, many devices fail to address the problem of thin or short hair. Other primary design functions described in many other patents revolves solely around methods to hold hair, while being void of embellishment descriptions. The present invention introduces apparatus not only to hold very short or long hair lengths but presents means to connect removeable decorative ornaments including hair extensions within the device, and means for attaching fixed ornaments, by utilizing differing methods of construction.

BRIEF SUMMARY OF THE INVENTION

An important object of the invention is to provide a retaining device that can hold lengths of hair in numerous arrangements.

A further object is to provide a device that can readily be applied, and adjusted to reliably grip and hold virtually any circumference of bunched hair without readily becoming loose.

Another object is to provide a hair holder that can be applied quickly without twisting or doubling over the device e.g. rubber bands, so common in other ponytail holders.

A further object is to provide one device that is capable of holding ornaments such as bows, hair extensions, scarfs, feathers, flowers etc. while also holding hair lengths in place, to create unique hairstyles, and a high fashion accessory.

Yet a further object is to provide a device that can be applied to hair lengths without first gathering hair.

Yet another object is to provide a device that firmly grips short or fine hair without using clips, teeth, or other devices that can damage hair.

Yet a further object is to provide a device that can quickly be engaged and disengaged from hair being held.

In accordance with the presently most preferred embodiment of the invention, a twisted internally stressed resilient convoluted member, preferably of natural gum or synthetic rubber, creates a hair holder band having first and second terminal portions, and a plurality of twisted expandable crossover loop portions between the terminal portions, for enabling gripping of hair, additional hairpieces or decorative objects within one or more crossover loop portions, once the convoluted member is surrounded by fabric. The terminal portions can be coupled together by numerous coupling means such as tie-fasteners, linking mechanisms, housing structures, strings, stitching, rings, or cube shaped connector devices for preventing unwinding of the twisted resilient member, and the result is an internally stressed, convoluted body, extendible by the application of force by a person's fingers, for opening selected loop portions to insert lengths of hair, hair extensions, or decorative objects such as jewelry therein. The loop portions are contractible in response to releasing such force to grip and hold the items in the loops. The resulting complex twisted loop configurations help create many variable hairstyles.

The twisted entangled resilient member is preferably a tube or cord length that tends to be easily maneuverable by the user's hands, however a rectangular strip can be utilized which may enhance gripping forces when applied to the user's hair due to its well defined edges. The interior resilient member is preferably covered and surrounded along its length with a decorative tubular fabric body that may be stitched around the resilient member utilizing differing techniques, to create unique embodiments. A preferred coupling means comprises a cable tie strap fastener, however custom constructed decorative members may be used. It will become apparent that the coupling means may be remarkably diverse. For example, stitching can be formed along the length of the twisted resilient member within the tubular fabric, with extensive stitching formed around the resilient members ends, preventing them from unwinding so as not to utilize an external connector. In contrast, large decorative rings or ornaments may be employed securing the twisted resilient member ends, whereby such rings may further serve the additional purpose of holding embellishments. The coupling means may be very visible and decorative or minimal and concealed by decorative fabric.

Also, a further ring member may be attached to the entangled convoluted member in separate ways to encompass loop portions that can also have decorative objects coupled thereto such as strips of fabric, hairpieces or jewelry. The ring member can be slid along the length of the resilient member to create numerous interesting attention getting displays.

The coupling means can comprise a first and second cube member coupled together, the first cube member fitted within the first terminal portion of the resilient convoluted band member and the second cube member fitted within the second terminal portion of the resilient convoluted band member. This coupling means enables the terminal ends of the convoluted member to be flush with respect to each other, in contrast with the other coupling devices mentioned above.

DRAWING DESCRIPTIONS

These and other features and advantages of the present invention will be better understood by reading the following detailed description, taken together with the drawings wherein.

Figure 3:
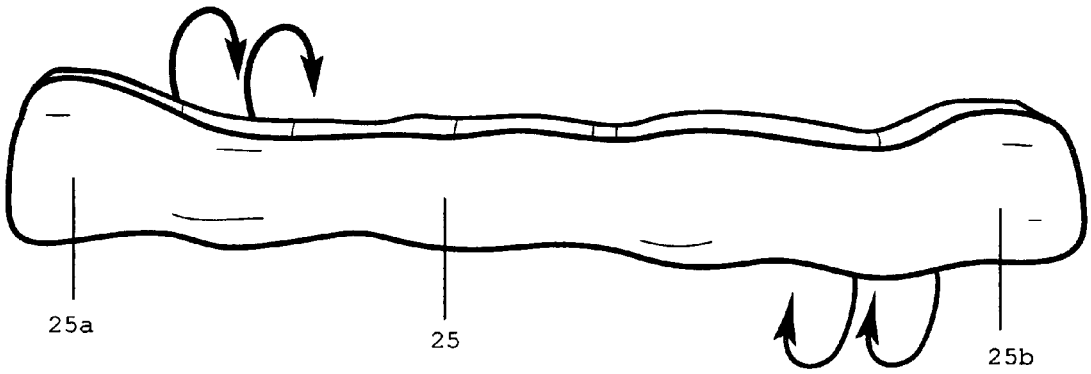
FIG. 3 is a perspective view of a rectangular resilient member prior to being twisted and made to assume a collapsed state by having its ends coupled together.
Figure 3A:
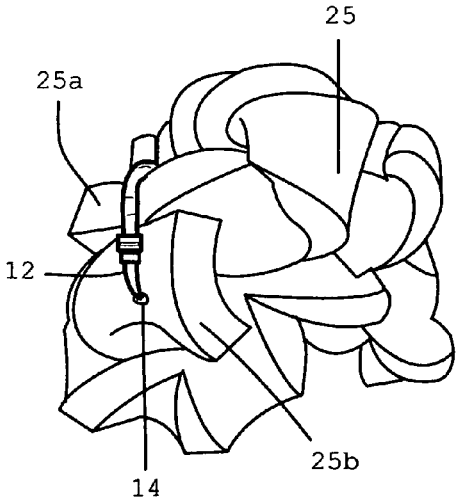

FIG. 3*a* shows a rectangular rubber strip in a twisted collapsed state after being turned fourteen revolutions and a conventional cable tie fastener for preventing the strip from unwinding.

Figure 3B:
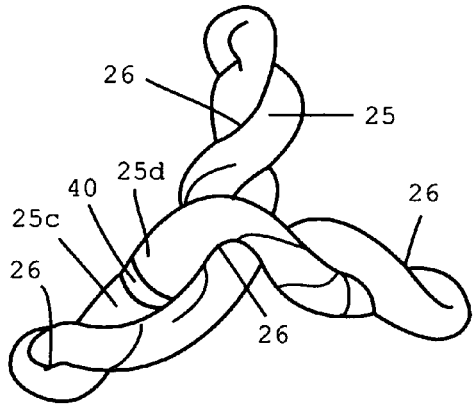

FIG. 3*b* shows a contorted natural rubber tubing member, having been turned nine full revolutions, with the ends coupled together by a tubing connector.

Figure 4:
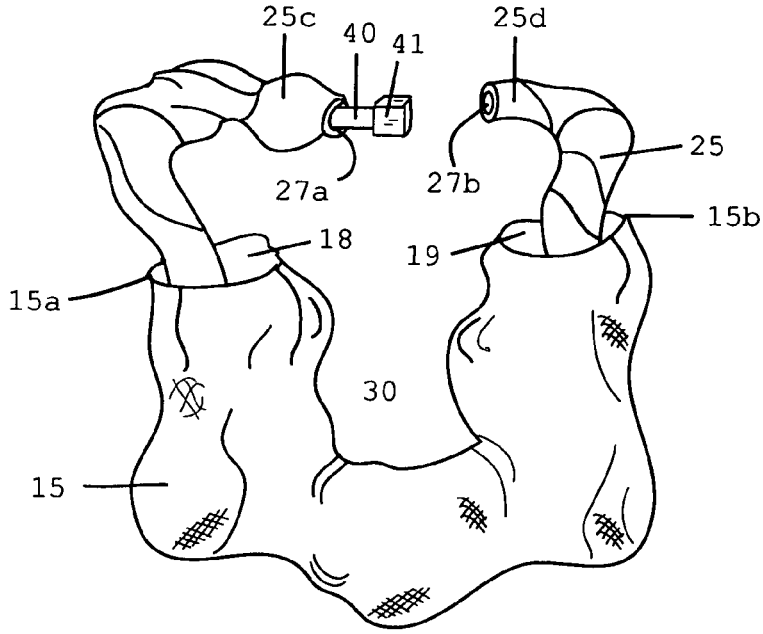

FIG. 4 is a perspective view of an embodiment of the hair holder in an open position showing a cube shaped connector for preventing the device from unwinding, whereby one cube at one end of a coupling bar has been inserted into one tubular end of the twisted rubber member, with the opposite tubular end ready to receive a second cube at the opposite end of the coupling bar.

Figure 5:
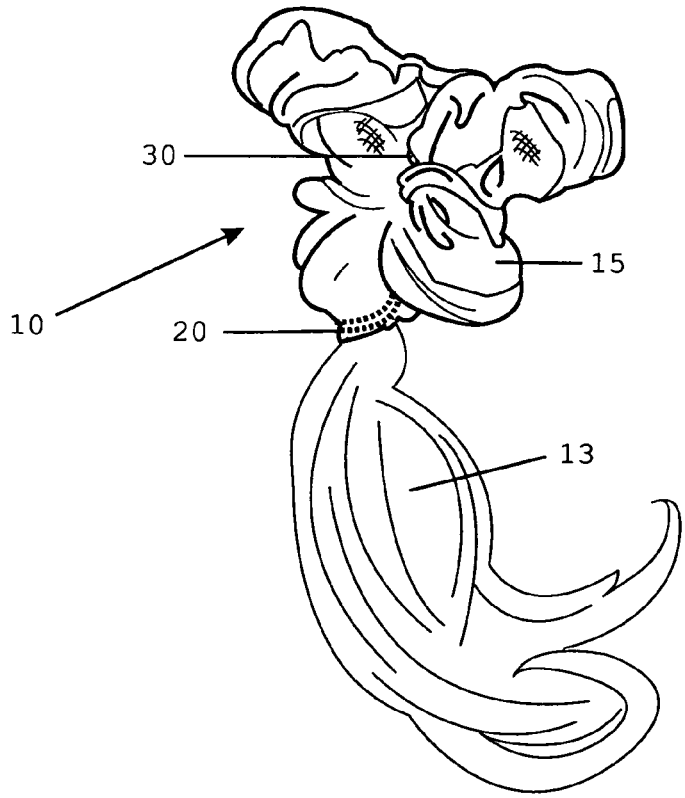

FIG. 5 shows how a hair extension piece may appear after being stitched onto a portion of the outer tubular fabric.

Figure 6:
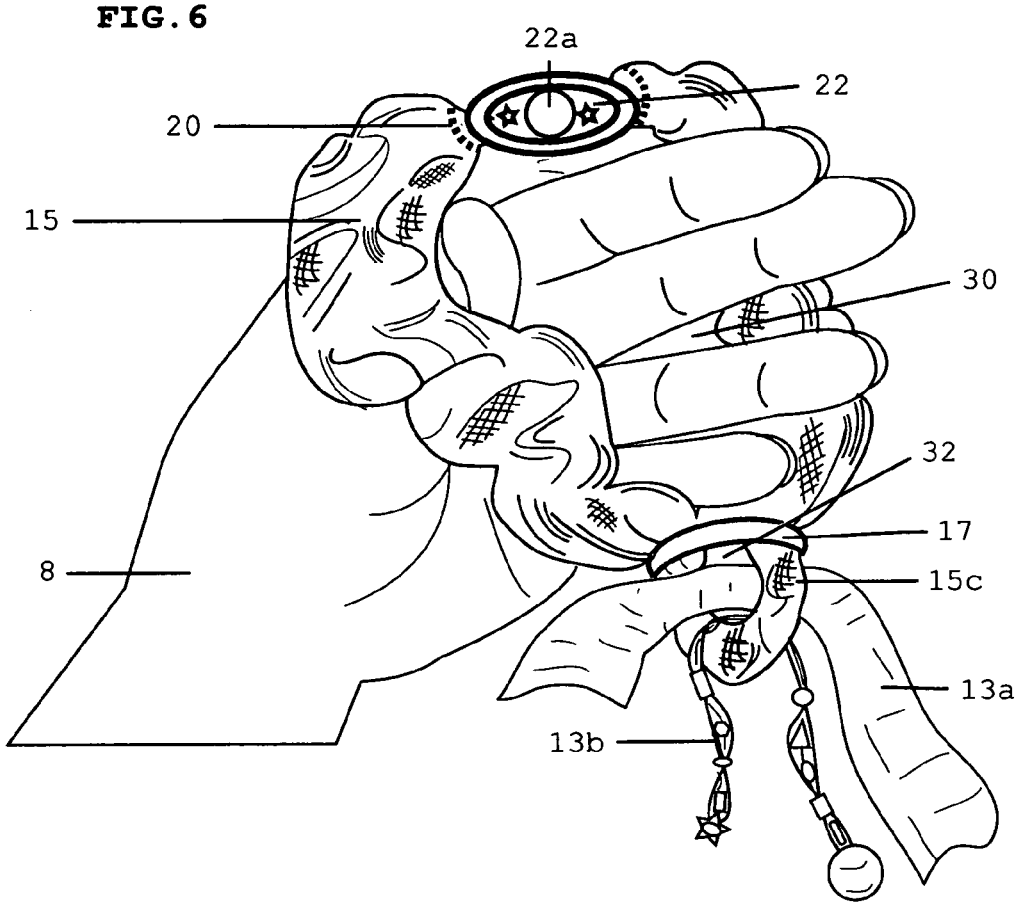

FIG. 6 is a perspective view showing a ring member passed over a portion of the resilient member for forming an auxiliary loop portion thereof. A jewelry piece and ribbon have been inserted through said loop. An ornamental ring coupling device is also shown in a position ready to receive further ornamental embellishments.

Figure 7:
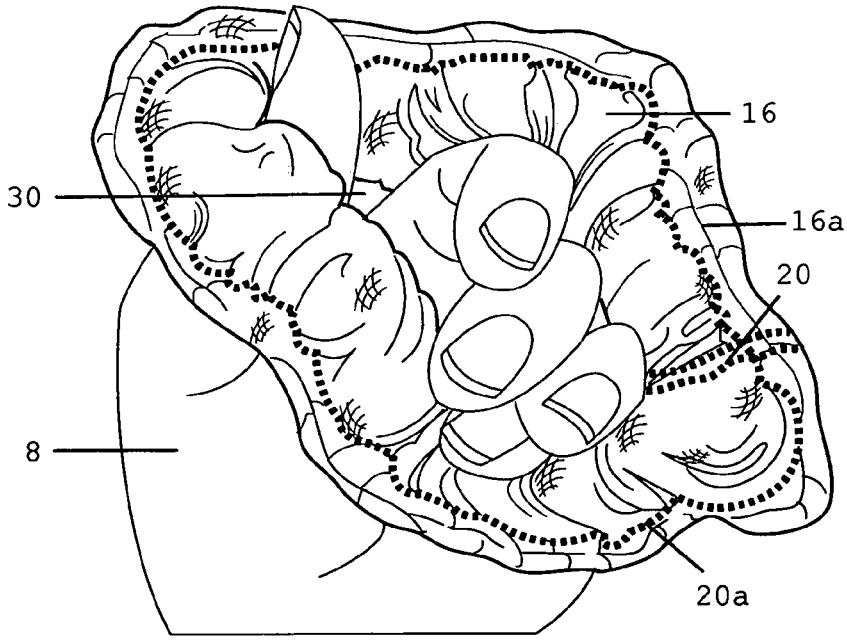

FIG. 7 illustrates an embodiment wherein a length of stretchable fabric has surrounded the twisted inner rubber core and been stitched in one line around the rubber core.

Figure 8:
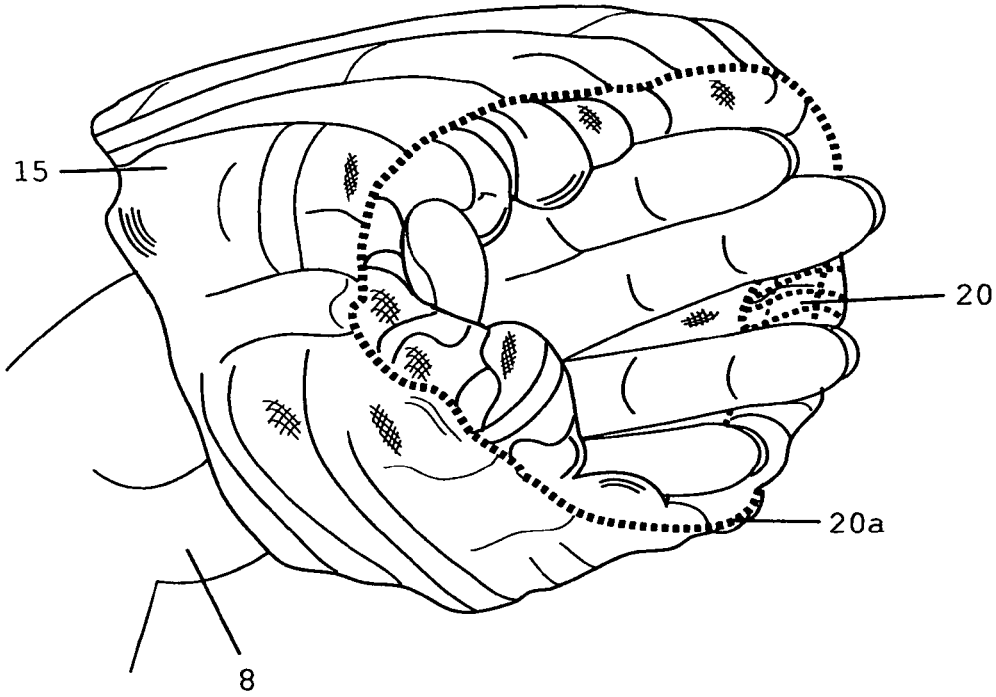

FIG. 8 illustrates a lengthened tubular fabric embodiment in an open position wherein the twisted rubber member has been stitched in place within and around the front interior of the tubular fabric.

Figure 9:
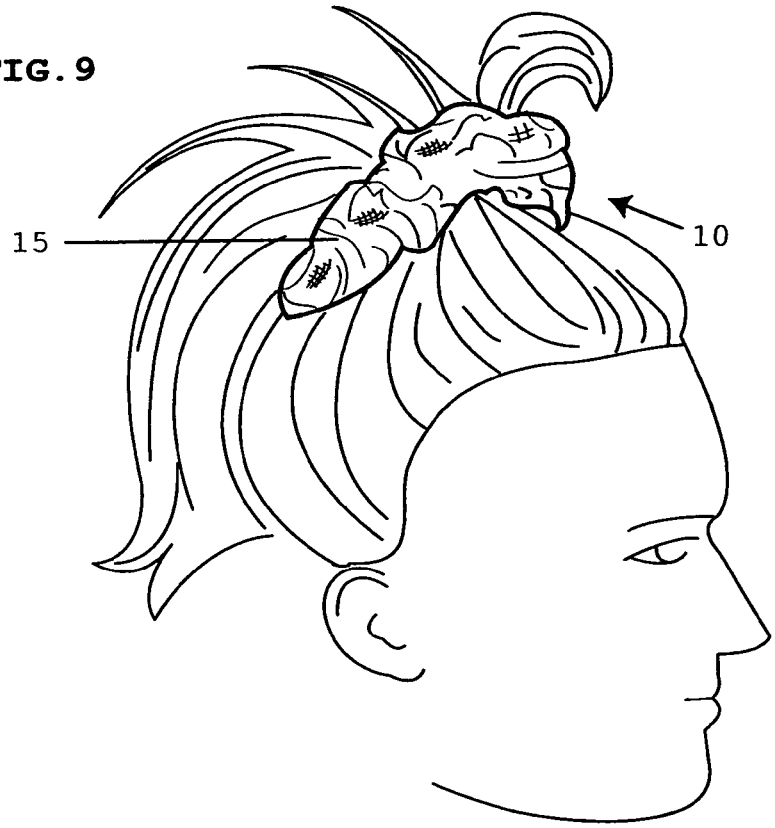

FIG. 9 shows collapsed hair holder upon the top of a wearer's head, and how separate 'spikes' of hair could appear if the device were fully opened and released onto a users hair.

DETAILED DESCRIPTION OF PREFERRED EMBODIMENTS OF THE INVENTION

In accordance with the present invention, a resilient natural rubber length strip, tubing or solid rubber cord length can be combined with a tubular fabric. Such a rectangular strip is shown in FIG. 3 having well defined edges that tend to enhance gripping forces when applied to the hair, which may be of more value when utilized in extreme sports for example. In a preferred embodiment, a tubular hollow fabric portion is used that is slightly longer than the rubber length. Initially, the rubber length is inserted through the longer hollow fabric tubular member 15 shown in FIG. 4. The rubber length is subsequently rotated at one longitudinal end while holding the opposite longitudinal end stationary, or rotating it in the opposite direction causing the rubber length to contort and contract. This is conducted while preventing the tubular fabric from also twisting upon itself by positioning it at one rubber end.

Before the two rubber ends 25*a* and 25*b* of FIG. 3 are coupled together, appropriate tension can be achieved in relation to how tight the device will eventually hold lengths of hair. The more the rubber length is rotated before the coupling step, the tighter the grip will become on the hair, while less rotating will result in a looser grip on the hair. Once the rubber ends are connected together as shown in FIGS. 3*a* and 3*b*, or attached separately onto a coupling mechanism to prevent unwinding, an internally stressed closed band having loop portions 26 is created, as shown in FIG. 3*b*. The twisted rubber loop has folded in, or enclosed in upon itself, creating a plurality of projections along 25 at odd angles with little loops 26 therein. FIG. 3*a* also contains numerous crossover loops, however are less visible than in twisted tube member 25 of FIG. 3*b*. Any gaps within the loop will enclose in upon themselves fully or partially, in relation to the dynamics of how the loop is opened and released by the users hands, and in relation to the degree of rubber length rotation.

As mentioned, the rotated rubber length ends can be held securely in place by a myriad of coupling means with several to be further described. For a solid rubber length a metal clamping sleeve, a metal wire/plastic ring shaped form, a small two piece plastic housing encasement could be used. Further means may involve a cinching/trapping mechanism, or a customized shape that would vary relating to the internal rubbers stress, shape, width, and eventual decorative effect desired. One such customized structure could include receiving cavity's or holes made on a decorative object whereby each opposite rubber end may be respectively inserted through, preventing the ends from unwinding. Current preferred coupling means comprise a conventional cable tie strap fastener 12 shown in FIG. 3*a* that encompasses the rubber end portions to tightly bind them together; the fastener may optionally pass through one or more holes 14 in the ends of the rubber. A further decorative object such as a ring could also be inserted within cable tie 12 before it is binded, holding the ring and rubber ends together. Such a ring member could also easily be pulled outwardly while holding a loop portion stationary, aiding the user in opening up the device, and applying to hair lengths. When rubber tubing is utilized locking means may involve inserting two opposite cube locking joints into each respective opposite longitudinal tubing end inner hole diameters, preventing unwinding of the rubber tubing as shown in FIG. 4. Further coupling means may comprise riveting the rubber ends together or a vulcanization heat fusing process, heat shrink tubing, or an elastomer-based adhesive.

Hence, a decorative convoluted self-collapsing hair band device is provided for gripping the hair or other decorative objects. Various configurations are achieved in the way the user manipulates the opening and releasing of the device onto hair, such as speed or extent of loop opening. The resulting opened device is capable of holding numerous items, on its own or together with strands of hair, when released after being extended. Opening the device can be achieved by inserting fingers within a band loop and regulating the circumference of the entire loop by opening fingers outwardly fully or partially, to the appropriate circumference in relation to an object to be held, as indicated in FIGS. 6 and 7. Decorative items of apparel, hair extensions, or light decorative objects, such as jewelry and fabric strips can be placed within the crossover loop portions of the hair band holding device, and subsequently held within the crossover loop portions by removing fingers before or after the device is placed on a users hair. As a result of removing fingers from within the holding device, the interior elastomer member crosses over upon itself, becoming entangled shown in FIGS. 3*a*, 3*b*, and pulls the exterior tubular fabric shown in FIGS. 1 and 5 inwardly together, decreasing the size of the device. The band becomes tight around a decorative article, or hair strands as shown in FIGS. 2 and 9, and a holding effect is achieved. This holding effect can serve a valuable purpose in securing a users hair in place, especially during sporting or leisure activities.

With slight modifications, the device can become increasingly decorative while retaining hair tightly. For example, a length of narrow cotton or nylon "Lycra" stretchable fabric shown as 16, and 16*a* in FIG. 7 may be utilized in place of the aforesaid tubular cloth fabric. Such stretchable fabric can be positioned around the twisted rubber lengthwise, with the ends subsequently stitched together 20, as shown in FIG. 7. This may be conducted after the rubber length has been twisted upon itself and connected together as in FIGS. 3*a* and 3*b*. Mentioned fabric compositions outer longitudinal edges tend to curl inwardly shown as 16*a* when a length of this fabric is cut, concealing the cut line, and making means to stitch it around the resilient member in a tubular form all in one stitch line 20*a*, leaving said curled longitudinal edges free, 16*a*. Furthermore, in wider lengths this fabric may simply be wrapped around the twisted rubber member, until encircled and stitched together at its longitudinal ends. Other fabrics that make means for a quick wrap around the twisted rubber member may include ones that consist of decorative fronts and decorative backs, such as scarfs. Once the rubber loop is opened by finger action and placed over a bundle of hair, and subsequently released by the user's fingers, a holding effect is achieved within loops where the device overlaps itself, which may occur at a few or numerous places along the circumference of the loop, according to its length and the amount of rotation the rubber member has been previously twisted. All such crossover loop portions along the circumference of the band enclose inwardly, in which the bulk of hair lengths will be held securely. Also, the device can easily slide off hair lengths by simply pulling outwardly on any portion of the device from the hair being held, allowing for a quick detachment of the device from the user's hair.

Figure 1:
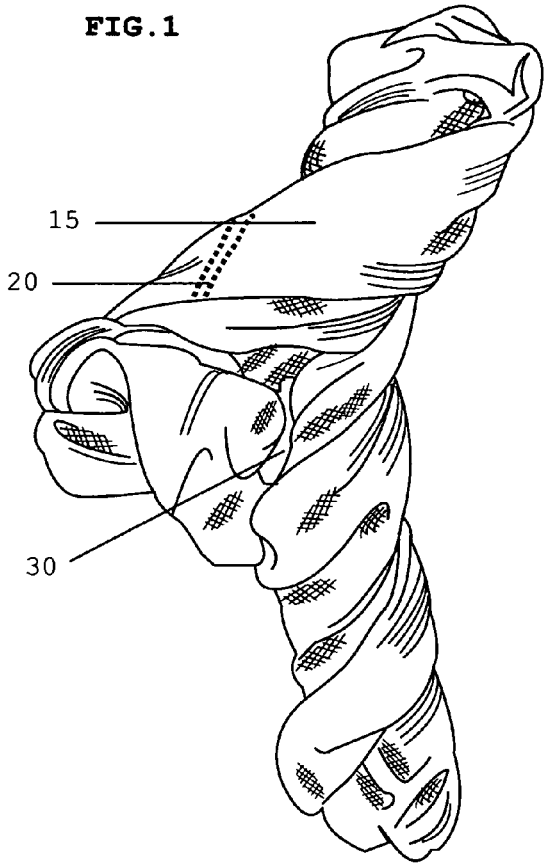
FIG. 1 shows the hair holder band device in a closed collapsed position (in its fully relaxed state).
Figure 2:
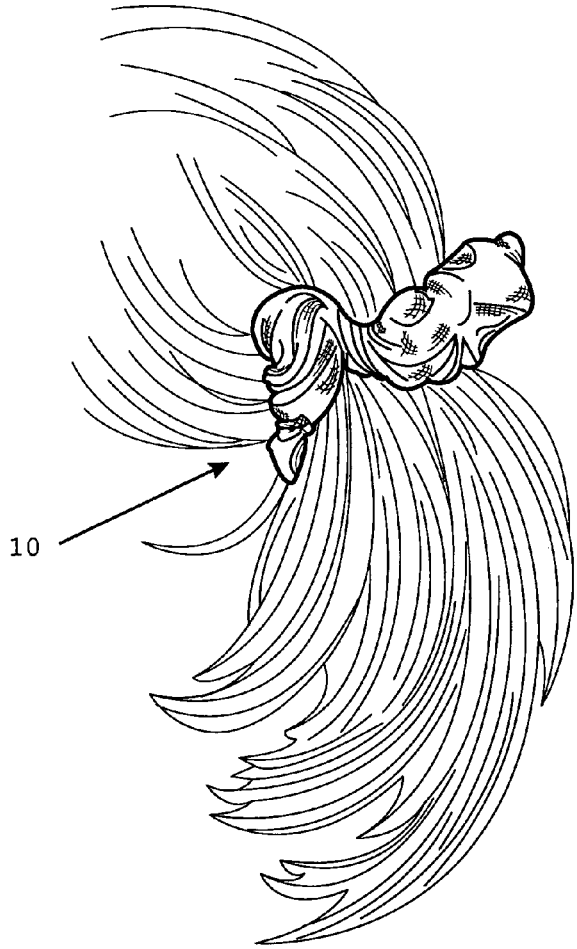
FIG. 2 illustrates the collapsed device holding large strands of hair.

More specifically, FIG. 1 shows the holding device in a closed position after being allowed to contract; 15 is the tubular fabric whereby a twisted and connected rubber tube length of FIG. 3*b* rests within it. Twisted rubber has been coupled together within tubular fabric 15 at the terminal portions 25*c* and 25*d* of FIG. 3*b* to prevent unwinding, to thereby maintain induced inner torsional stress on the tubular member, with rotating action having caused the device to collapse and crossover itself. Both longitudinal outer ends of tubular fabric 15 have been sewed together, shown as 20, concealing the way the rubber ends are connected together. The rubber interior is never visible in any embodiment, always being surrounded by fabric. Loop portion 30 shows a small opening in which user's fingers can be inserted to open up the holding device partially or fully as shown in FIGS. 6 and 7 to effectively grip hair lengths, as shown by embodiment 10 in FIG. 2.

In any case, FIG. 3*a* shows the rubber strip 25 of FIG. 3 in a twisted form. It has been turned fourteen full rotations with one or more holes 14 having been punctured therein, and a conventional cable tie-strap fastener 12 employed to hold terminal portions 25*a* and 25*b*, of the rubber member together. Rotations may vastly vary according to length, width of rubber member and desired holding effect. A cable tie fastener is currently preferred when utilizing a cord or rectangular rubber strip as it is small and has a low profile, and may further be quickly connected to 'non customized coupler objects,' such as small or large rings, decorative bars etc. along with the twisted rubber ends. A tightly knotted cord, string or other unobtrusive member could be used in place of the tie-strap fastener as would be readily understood by an ordinary worker in the art. The terminal portions may not require punched holes at all to reduce manufacturing costs, but may be present so as to aid in keeping ends flush together, avoiding a 'bump' in the twisted rubber when connected together, as opposed to connecting twisted rubber opposite terminal ends to opposing sides of an independent object similar to what is shown in FIG. 6. For an exemplary low profile cable tie-strap fastener reference may be made to U.S. Pat. No. 6,698,069 to Caveney et al.

FIG. 3*b* shows cylindrical contorted rubber tubing 25 having been turned nine full rotations and has a length of twelve inches. Crossover loops 26 and terminal portions 25*c* and 25*d* are shown at portion 40. While a regular available 'shelf ' tubing connector could sufficiently prevent the rubber from unwinding, a more secure coupling means consists of a small bar portion 40, connected to two small cubes 41 that can be inserted in tubular ends 25*c* and 25*d*, through tiny interior tubular diameters 27*a* and 27*b* shown in FIG. 4. One cube has been already inserted into end portion 25*c*. Also rather than inserting them into tubing, the cubes could be inserted into apertures formed in non-tubular members. It is also important to note that the twisted rubber length of FIG. 4 could be positioned onto the outside of the tubular fabric 15's length with the tubular fabrics length being folded over widthwise in half, encircling the twisted rubber. Opposing tubular fabric inner and outer lengths can then be stitched together in a tubular form, surrounding the twisted rubber and coupler once connected. This creates more interior padding of the twisted rubber though utilizes 'twice' the fabric. Further padding means may involve adding fiber filling or padding material within tubular fabric openings 18 and 19 of FIG. 4, to effectively soften the grip on hair, or may include wrapping additional fabric lengths around the tubular fabric, or involve inserting the rubber length through two separate tubular fabrics.

Ornamental objects of various shapes and sizes such as medallion 22 of FIG. 6 could comprise the coupling means, coupling the rubber terminal portions together. Connecting bar 40 of FIG. 4 could also be much wider, longer, or arched shaped. Either way the decorative fabric ends are sewed together or apart on a coupler, always covering 27*a* and opposite end 27*b* of FIG. 4. The embodiment may also consist of a very long narrow twisted rubber length with maybe 10 or 12 crossover loops, that are combined with very narrow tubular fabrics. Alternatively, the rubber member may be very short with less of the aforesaid rotating action before being coupled together, designed to hold small portions of hair lengths, and may be combined with a ring connector 22 in FIG. 6, that also allows for embellishments to be placed through opening 22*a*.

The FIG. 5 embodiment 10 varies in shape from FIG. 1 since it utilizes a twisted rubber strip as shown in FIG. 3*a*, that has been excessively rotated resulting in a more circular closed shape. This embodiment may also hold a bundle of hair more tightly, not only from excessive rubber rotating, but resulting from utilizing a rectangular rubber strip shape having defined or jagged edges, depending on how its cut. As mentioned above, using such shapes may be more useful when a very secure hair holder may be required. Also as shown, a hair extension member e.g. a hairpiece 13 has been added by means of stitching it's outer end onto a portion of the tubular decorative material fabric 15 at 20. Portions of the hair extension can then be looped or wrapped around interior opening 30 (making it appear hair is connected to the users hair once applied) or left loosely in place. A hair extension length could also be stitched onto a length of fabric along a part, or whole of the fabric outer edge(s), before the fabric is stitched into a tubular fabric embodiment. Subsequently, a twisted rubber length can be inserted consistent with previous descriptions.

However, a presently more preferred method of attaching hair extensions and the like can be seen in FIG. 6. A ring member 17 that could be made of metal, plastic, or an elastic material, has been added to the embodiment therein to 'isolate' one or more loops shown as single loop 32, being in an open position ready to receive a hair extension member or other decorative item. Ring member 17 may optionally include a cross bar across a central portion of the ring to prevent it from falling off the device if the ring is not elastic. Once a decorative embellishment such as a ribbon or scarf 13*a* and/or a jewelry piece 13*b* shown in FIG. 6 is placed inside open loop 32, and tension released, the diameter of loop 32 will diminish, to hold the decorative item in place. Subsequently, the ring can be moved downward to hold the decorative item more firmly in place, and prevent it from falling out when loop 30 is in an open position. This method makes it possible to add and remove hair extensions, or light decorative embellishments such as 13*a* and 13*b*. The ring can also be centered in the middle of the embodiment and hold hair in two separate places. Additionally, such decorative items may simply be placed loosely within loop 30 of FIG. 6 void of ring 17 and subsequently joined to lengths of hair. There are numerous other ways to attach synthetic hair lengths to the embodiment such as adding a ring member that has hair lengths already attached to it, over the tubular fabric prior to connecting the rubber ends together, or tying or knotting many different color hair extensions at different points along the loops in different places. Hair extensions may also be more effective when combined with narrower tubular fabrics that 'hug' the circumference of the interior twisted rubber member such as shown in FIG. 7.

Ring member 17 can also be employed in another manner. If the ring only encompasses one portion of the device, say encircling around point 15*c* only, without encompassing a second portion of the device as it is now shown positioned in FIG. 6, it may be readily slid all along the length of the contorted embodiment to be positioned in varying places upon the wearer's hair. Extended decorative items such as 13*a* and 13*b* of FIG. 6 may be inserted into the ring for varying effects. In this arrangement, the ring is prevented from falling off of the device and may be easier to adjust. Yet a further way to add more decorative items such as flowers, scarfs, feathers etc. is utilizing a decorative ring coupler such as 22 in FIG. 6 whereby mentioned decorative items and the like may be inserted and removed from within ring opening 22*a* of coupler 22. Twisted rubber ends may also be attached accordingly to just a ring member like 17 in FIG. 6 acting as the coupling means in place of coupler 22.

FIG. 8 shows a lengthened tubular fabric 15 in an open position and shows how the interior twisted rubber can be held in place by stitching the tubular fabric together in a circular pattern following the twisted rubber member's outer edge, shown as stitching line 20*a*. It also shows extensive stitching at point 20 where the rubber ends meet inside the fabric. This extensive stitching alone can prevent the rubber ends from unwinding and results in an embodiment void of metal or clamping mechanisms. Also by utilizing lengthier tubular fabric and stitching the interior rubber member in place, the fabric maintains its original appearance or remains 'uncrinkled' or less bunched together, uncommon in other hair holders. Portions of the lengthier fabric can also be folded under the twisted rubber loop. Either way in it's relaxed closed state the twisted rubber interior directs the fabric to undefined angles similar to FIG. 1. FIG. 9 shows the FIG. 8 arrangement in a user's hair. It also shows the hair being retained at a few different points, being held within the plurality of crossover loops.

Further modifications of the described embodiments may occur to workers in the art within the scope of the invention as defined by the following terms in the claims and art recognized equivalents. While elastomers such as natural or synthetic rubber are presently preferred for the interior core material, other resilient materials can be employed that have similar mechanical characteristics, e.g. springy plastics or spring steel coated with a soft material. The term "resilient convoluted member" as used herein refers to a manually expandable internally stressed member that, in its relaxed state, consistently coils up and forms into a twisted wound-up shape. Regarding "resilient" and "convoluted" see Websters New Universal Unabridged Dictionary, 1994.

The term "decorative material" refers to flat or tubular fabric or cloth, but may include other suitable materials such as fur, elastics, beads, feathers, synthetic soft fibers such as rope or hair, decorative flexible plastics, or tubular or foam rubber compositions that may permit the device to entangle and collapse while maintaining eye appeal and holding capabilities. The term "ornament" comprises an ornamental member with or without another decorative item such as a length of cloth, flower, or a string of beads coupled thereto.

I claim:

1. A device for holding hair comprising:

(a) a manually expandable internally stressed resilient self-collapsing convoluted member that, in its relaxed state when not applied to said hair, is consistently coiled up and is formed into a twisted wound-up collapsed structure having first and second terminal portions and a plurality of expandable non-coincident loop portions for gripping of said hair, additional hairpieces or decorative objects within said loop portions; and (b) coupling means for coupling first and second terminal portions of said resilient convoluted member together for preventing unwinding of said resilient convoluted member and wherein the member has a rotating action having the member to collapse and crossover itself.

2. The device of claim 1 wherein said coupling means comprises a tie strap fastener.

3. The device of claim 1 wherein said coupling means comprises an ornamental member.

4. The device of claim 3 wherein said ornamental member comprises a ring member.

5. The device of claim 4 wherein a ring member encompasses loop portions of said resilient convoluted member and wherein said ring member can optionally include decorative objects therein.

6. The device of claim 3 wherein decorative material is positioned over said resilient convoluted member.

7. The device of claim 3 wherein a ring member encompasses loop portions of said resilient convoluted member and wherein said ring member can optionally include decorative objects therein.

8. The device of claim 3 wherein said resilient convoluted member comprises an elastomer.

9. The device of claim 1 wherein decorative material is positioned over said resilient convoluted member.

10. The device of claim 1 wherein a ring member encompasses loop portions of said resilient convoluted member and wherein said ring member can optionally include decorative objects therein.

11. The device of claim 1 wherein said resilient convoluted member comprises an elastomer.

12. The device of claim 1 wherein said resilient convoluted member consists of a rectangular strip having well defined edges.

13. The device of claim 1 wherein said coupling means comprises a first and second cube member linked together, said first cube member fitted within said first terminal portion of said resilient convoluted member and said second cube member fitted within said second terminal portion of said resilient convoluted member, and wherein said resilient convoluted member is tubular.

14. A device for holding hair comprising a resilient self-collapsing convoluted member having an internalized torque therein and that, in its relaxed state when not applied to said hair, is consistently coiled up and is formed into a twisted wound-up collapsed structure having a plurality of manually expandable non-coincident widely loop portions for gripping of said hair, hairpieces or decorative objects within said plurality of expandable non-coincident loop portions and wherein the member has a rotating action having the member to collapse and crossover itself.

15. The device of claim 14 wherein decorative material is positioned over said resilient convoluted member.

16. The device of claim 15 wherein a ring member encompasses loop portions of said resilient convoluted member.

17. The device of claim 14 wherein a ring member encompasses loop portions of said resilient convoluted member.

18. The device of claim 14 wherein said resilient convoluted band member comprises an elastomer.

19. The device of claim 14 wherein said convoluted member consists of a rectangular strip having well defined edges.

20. A device for holding hair formed by twisting ends of a resilient elongated member relative to each other to induce an inner torsional stress within said resilient elongated member and joining said ends together for creating a resilient self-collapsing convoluted member that, in its relaxed state when unapplied to said hair, is consistently coiled up and is formed into a twisted wound-up collapsed structure having a plurality of non-coincident loops for gripping of said hair, additional hairpieces, or decorative objects within said resilient elongated member portions and wherein the member has a rotating action having the member to collapse and crossover itself.

21. The device of claim 20 wherein decorative material is positioned over said resilient elongated member.

22. The device of claim 20 wherein said resilient convoluted member consists of a rectangular strip having well defined edges.

* * * * *

UNITED STATES PATENT AND TRADEMARK OFFICE

CERTIFICATE OF CORRECTION

PATENT NO. : 7,637,266 B1
APPLICATION NO. : 11/393574
DATED : December 29, 2009
INVENTOR(S) : Roger C. Gibbons It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 431 days.

Signed and Sealed this

Twenty-first Day of December, 2010

David J. Kappos

David J. Kappos
*Director of the United States Patent and Trademark Office*